10/17/85 4,546,558

United States Patent [19]

Perini

[11] Patent Number: 4,546,558

[45] Date of Patent: Oct. 15, 1985

[54] SKI BOOT

[76] Inventor: Sergio Perini, 3 Viale Metronio, Rome, Italy

[21] Appl. No.: 558,359

[22] Filed: Dec. 5, 1983

[30] Foreign Application Priority Data

Dec. 7, 1982 [IT] Italy ..... 36198/82[U]

[51] Int. Cl.[4] ..... A43B 5/04

[52] U.S. Cl. ..... 36/120

[58] Field of Search ..... 36/117–121, 36/105

[56] References Cited

U.S. PATENT DOCUMENTS 3,529,369 9/1970 Drago ..... 36/120
3,538,627 11/1970 Labat-Camy ..... 36/120
4,152,849 5/1979 Frechin et al. ..... 36/120

FOREIGN PATENT DOCUMENTS 1959022 6/1970 Fed. Rep. of Germany ..... 36/118
2371895 6/1978 France ..... 36/120
2433311 3/1980 France ..... 36/121

*Primary Examiner*—James Kee Chi
*Attorney, Agent, or Firm*—Fleit, Jacobson, Cohn & Price

[57] ABSTRACT

A ski boot having a stiff bootleg with an adjustable lateral inclination by means of a semicircular laminar stirrup linked to the bootleg itself and sliding within an appropriate hollow in the heel of the boot, and clamping means provided in the hollow for locking the stirrup in the desired position.

7 Claims, 3 Drawing Figures

SKI BOOT

BACKGROUND OF THE INVENTION

The present invention relates to a ski boot, or a boot for similar uses, having a basculating stiff bootleg with an adjustable lateral inclination for the fitting thereof to any kind of natural inclination of the leg of the user.

Known ski boots having a stiff leg generally provide foward inclinations in a vertical plane passing along the longitudinal axis of the foot, which inclinations may be fixed or, on the other hand, variable by means of lateral pin joints.

Said known ski boots do not allow adjustment of the lateral inclination of the stiff leg of the boot itself, i.e. in a transverse vertical plane with respect to the longitudinal axis of the foot.

Under the circumstances, it is obvious that the known boots compel the leg of the user to assume, in said transverse vertical plane, a position forming, with respect to the horizontal plane, an angle equal for all the users, that is the angle provided by the manufacturer.

On the contrary, it is known that the natural angle of lateral inclination of the human leg varies from individual to individual. Consequently, when said angle does not coincide with the angle provided by the manufacturer of the boot, the foot settles in an anomalous position causing, when the leg is in the vertical position, a misalignment between the plane of the sole of the boot and the horizontal plane.

In order to obviate this disadvantage and to re-create a correct alignment, several kinds of lateral adjustment means are known. For example, a shim having a laterally inclined plane along the whole length of the sole can be set under the sole itself or the thickness of the sole can be uniformly reduced towards one of the lateral sides of same.

Further known means for obtaining the variation of said lateral inclination consist, for example, in using insoles inside the boot, which are appropriately shaped with rises or reductions in order to correct the transverse position of the leg. Adjustment mechanisms are also known, employing screws or pre-established positions by means of teeth or the like, which are placed outside the bootleg on its external part, in proximity to the pin joint provided for the forward adjustment of the inclination during use, allowing to raise or lower the corresponding part of the bootleg from the outside.

However, all these kinds of adjustment means present considerable disadvantages. More particularly, the insertion of a laterally inclined shim under the sole, although re-creating a correct alignment between the plane of the sole and the horizontal plane, leaves unchanged the position of the foot and of the leg with respect to the pre-established position of the boot, which is a non natural position for the user.

The use of screw or pre-established position adjustment mechanisms presents the disadvantage of twisting the bootleg, so settling the closing edges and consequently the clamping levers in unaligned position.

SUMMARY OF THE INVENTION

The boot according to the present invention purposes to avoid the above mentioned disadvantages of the known boots, allowing a micrometrical lateral adjustment of the bootleg, so as to fit it to the natural inclination of the leg of the user.

The boot of the invention comprises a fixed hull and a stiff bootleg linked in a known manner, for example by means of pin joints, to a semicircular laminar stirrup obtained from a strong and antislip material, such as antislip, or appropriately rendered antislip, steel, aluminium, plastic material or the like. Said stirrup laterally encircles the fixed hull and passes through it, in the transverse direction, in proximity to the heel, through a hollow in which opposing wedge clamps are provided, sliding on a dovetail guide, the upper surface of which is shaped according to the external surface of the stirrup and which can be moved one with respect to the other in a transverse direction by means of one or more tightening screws operable from the outside.

Once the clamps are moved away one from the other by operating said screw and so releasing the stirrup, the bootleg is adjusted in the desired position and is then fixed in such a position by moving the clamps one towards the other with an operation and a movement opposite to the above mentioned ones, consequently pressing the stirrup between the upper surface of the hollow and the curved part of said clamps.

DESCRIPTION OF THE DRAWINGS

These and further features will be more clearly apparent from the following particularized description of the boot according to the invention, which is illustrated in the accompanying drawings, in which.

DETAILED DESCRIPTION

Figure 1:
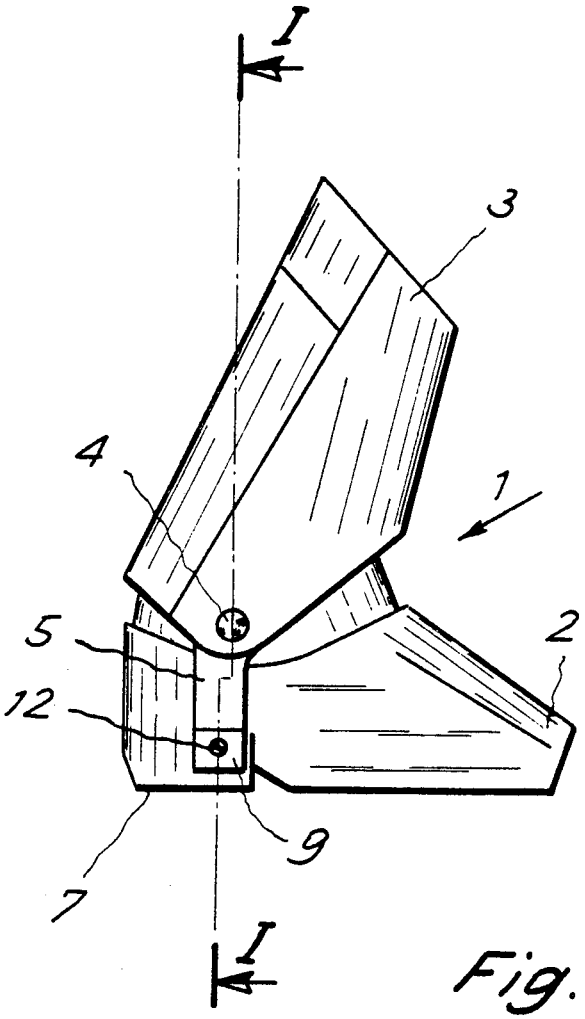
FIG. 1 is a side view of the boot.
Figure 2:
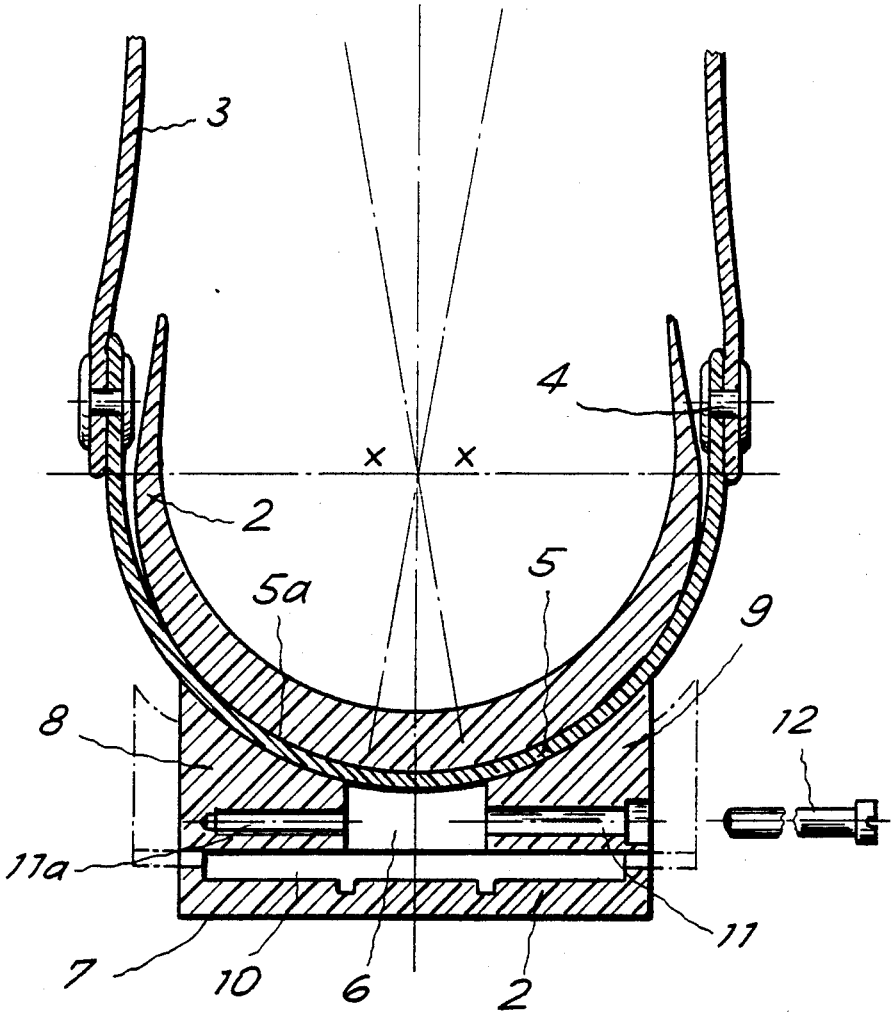
FIG. 2 is a sectional view, taken along line I—I in FIG. 1, of the boot with the bootleg clamped and the axis in the central position.

Referring to the FIGS. 1 and 2, there is shown a ski boot 1 consisting of a fixed hull 2 and of a stiff bootleg 3 which is linked in a known manner by means of rivets 4 or the like to a semicircular laminar stirrup 5 obtained from a strong and antislip material, or a material appropriately rendered antislip for example by surface roughness, such as antislip steel, aluminium, plastic material, capable of withstanding particular tensile, bending and impact stresses.

Said stirrup 5 passes the hull 2 in a transverse direction through a hollow 6 having a semicircular upper surface 5*a*, obtained in the sole in proximity to the heel 7.

According to this disposition of the invention, the stiff bootleg 3 can oscillate forward and backwards around the rivets 4 in a longitudinal vertical plane, while it can also rotate in a lateral direction, in a plane perpendicular to the longitudinal axis of the foot, around a center X—X constituting the center of curvature of the stirrup 5 and of the surface 5*a* of the hollow 6.

According to the present invention, during the use of the boot the bootleg is clamped in the desired position once it has obtained the lateral inclination allowing the bootleg itself to fit to the anatomy of the leg of the user, while the forward and backwards oscillation of the bootleg is free to follow the movement of the human leg.

To this purpose, the present invention provides a clamping system, for example by means of a pair of wedge clamps 8–9, oppositely sliding inside said transverse hollow 6, having the upper surfaces shaped according to the curvature of said stirrup 5 and the lateral and lower surfaces shaped according to the corresponding parts of the transverse hollow 6. According to a preferred embodiment of the invention, the lower surfaces of the wedge clamps 8–9 are shaped so as to slide on a dovetail guide 10 or the like obtained from an appropriate material added to the sole of the boot in order to hold said clamps within the hollow 6.

Said wedge clamps 8–9 are crossed by an internal thread 11*a* and by a hole 11 respectively, so that a screw 12 introduced inside the hole 11 and duly engaged in the internal thread 11*a* causes the two clamps 8–9 to approach one towards the other.

Figure 3:
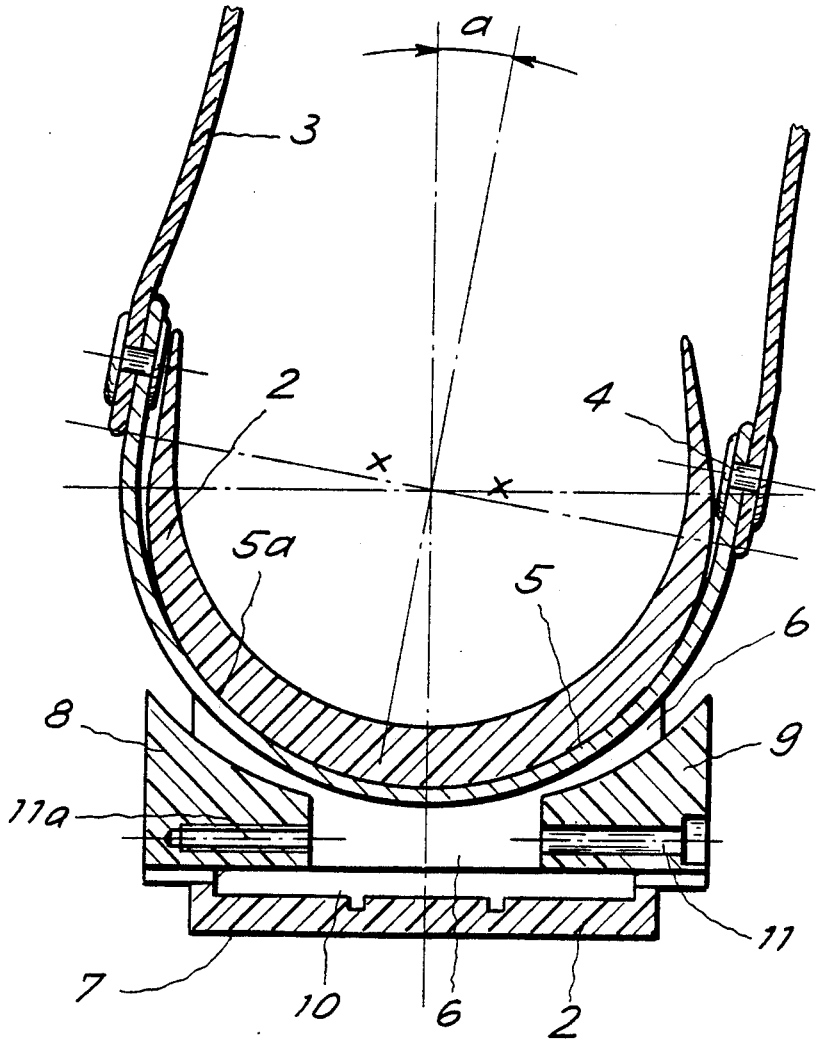
FIG. 3 is a sectional view, taken along line I—I in FIG. 1, of the boot with its leg released and laterally inclined with respect to the central position, during the adjustment stage of the inclination.

Referring to FIG. 3, the boot is shown during the adjustment stage of the lateral inclination according to the invention. In order to obtain the desired inclination, it will be sufficient to loosen the screw 12, so releasing the clamps 8–9 from the stirrup 5, and to rotate the bootleg 3 around the center X—X, for example outward as shown in the figure, for a certain angle a. To this purpose, the user has to loosen the screw 12, so moving the clamps 8–9 away one from the other, to put on the boot 1, to close the clamping levers provided for holding the boot to the foot and to do some flexion movement so as to make easier the free fitting of the inclination of the bootleg 3 of an angle a to the particular inclination of the leg of the user by the sliding of the stirrup 5 within the hollow 6. Finally, the user has to tighten the screw 12, which is engaged in the internal thread 11*a* of the clamp 8, until the stirrup 5 is completely clamped in the desired position by the action of the clamps 8–9.

According to the present invention, the dimensions of the clamps 8–9 are such that, when tightened, they do not laterally project outside the heel of the fixed hull 2.

Many variations may be made to the above described embodiment, for example insofar as the system for clamping the stirrup 5 is concerned as well as with regard to the type and to the material of the stirrup itself, without thereby departing from the scope of the present invention.

What is claimed is:

1. A ski boot having a stiff bootleg with an adjustable lateral inclination, said boot comprising: a fixed hull; a stiff bootleg pivotally linked to a substantially rigid, curved stirrup laterally encircling the hull and passing through it in the transverse direction within a hollow situated in proximity to a heel of the boot, so as to allow lateral inclinations of the bootleg in a transverse vertical plane with respect to the longitudinal axis of the foot of the user, and clamping means for locking the stirrup in the desired position relative to the hull to provide a desired transverse angular orientation between said bootleg and said hull.

2. A ski boot according to claim 1, wherein the clamping means includes a pair of opposed wedge clamps each having an upper surface shaped according to the curvature of the stirrup and engageable therewith, said clamps carried within a transverse hollow having a semicircular upper surface provided in proximity to the heel of the boot and movable toward and away from each other, and screw means extending between and connecting said wedge clamps to draw the clamps toward each other so as to clamp the stirrup in the desired position relative to the hull.

3. A ski boot according to claim 2, wherein the wedge clamps slide on a dovetail guide provided in the hull of the boot.

4. A ski boot according to claim 3, wherein the wedge clamps have appropriate dimensions so as not to project outside the fixed hull, in a lateral direction, once the screw means has been tightened.

5. A ski boot according to claim 1, wherein said stirrup is a flat loop in the form of a circular arc.

6. A ski boot according to claim 5, wherein said stirrup is metallic.

7. A ski boot according to claim 6, wherein said stirrup has a roughened surface to prevent slippage thereof relative to said hull.

* * * * *